US005530531A

United States Patent [19]

Girard

[11] Patent Number: 5,530,531

[45] Date of Patent: Jun. 25, 1996

[54] MULTIPLE CARTRIDGE KEYING APPARATUS

[75] Inventor: James J. Girard, Boise, Id.

[73] Assignee: Hewlett-Packard Company, Palo Alto, Calif.

[21] Appl. No.: 404,793

[22] Filed: Mar. 15, 1995

[51] Int. Cl.[6] ..... G03G 15/06

[52] U.S. Cl. ..... 355/260; 222/DIG. 1

[58] Field of Search ..... 355/260; 222/DIG. 1; 347/86; 141/311 R, 367

[56] References Cited

U.S. PATENT DOCUMENTS

| | | | |
|---|---|---|---|
| 4,611,899 | 9/1986 | Kasamura et al. | 355/260 |
| 4,907,019 | 3/1990 | Stephens | 347/86 |
| 5,293,913 | 3/1994 | Preszler | 141/367 |

FOREIGN PATENT DOCUMENTS

| | | | |
|---|---|---|---|
| 61-25168 | 2/1986 | Japan | 355/260 |
| 61-28979 | 2/1986 | Japan | 355/260 |
| 61-162071 | 7/1986 | Japan | 355/260 |

*Primary Examiner*—William J. Royer
*Attorney, Agent, or Firm*—Anthony J. Baca

[57] ABSTRACT

The present invention insures that the proper color toner used in a color printer is replaced once the present supply is consumed The printer has several of receptacles, one receptacles for each colored toner. Each receptacle has a unique key receptacle. The replacement toner comes in a cartridge, one cartridge for each color of the several of colored toners. A cartridge is constructed from a common body to which an endcap is attached. The endcap has a unique key that mates with only one of the unique key receptacles. Each cartridge is removably inserted in the correct receptacle.

10 Claims, 6 Drawing Sheets

MULTIPLE CARTRIDGE KEYING APPARATUS

TECHNICAL FIELD

The present invention generally relates to cartridge replacement; and more specifically, to replacing toner cartridges in a multi-color electrophotographic printer.

BACKGROUND OF THE INVENTION

As known in the art of electrophotographic printers, a photographic surface in the electrophotographic printer is first charged to a uniform potential and then is "exposed" to an image to be reproduced by the scanning of a laser beam thereacross. The photoconductor thereby obtains and electrostatic latent image that constitutes a matrix of discharged pixels on the photoconductor's surface. In a black and white printer, the photoconductive surface is generally developed using a black toner that adheres to the discharged pixel areas to form the image. Thereafter, the toned photoconductive surface is then carried to a transfer station where the image is transferred to a media sheet.

In a multi-colored printer, successive images are developed employing different color toners supplied from corresponding toner modules. Color printing is normally done with yellow, cyan and magenta toner that are applied, in registration, during successive rotations of the photoconductive surface. The printer also generally includes a toner module with black toner.

As the toner in a cartridge, or reservoir, (herein referred to as a cartridge) is expended, the cartridge must be replaced. A toner cartridge must be replaced with a new cartridge of the same color. This, like for like, replacement reduces chances for contaminating the new toner with old toner of a different color. An additional benefit from like for like replacements is reduced printer complexity because the printer does not need to sense the location of each color. However, like for like replacement requires that the user insert the proper color in the proper location.

One approach is to color the toner cartridge to correspond to the toner color. This simple solution does not take into consideration the significant percentage of the population that is color blind. Another approach requires that the printer sense that the correct type toner cartridge has been inserted. One skilled in the art understands that this sensing requires additional hardware and firmware.

SUMMARY OF THE INVENTION

The present invention insures that the proper color toner used in a color printer is replaced once the present supply is consumed The printer has several receptacles, one receptacle for each colored toner. Each receptacle has a unique key receptacle. The replacement toner comes in a cartridge, one cartridge for each color of the several of colored toners. A cartridge is constructed from a common body to which an endcap is attached. The endcap has a unique key that mates with only one of the unique key receptacles. Each cartridge is removably inserted in the correct receptacle.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
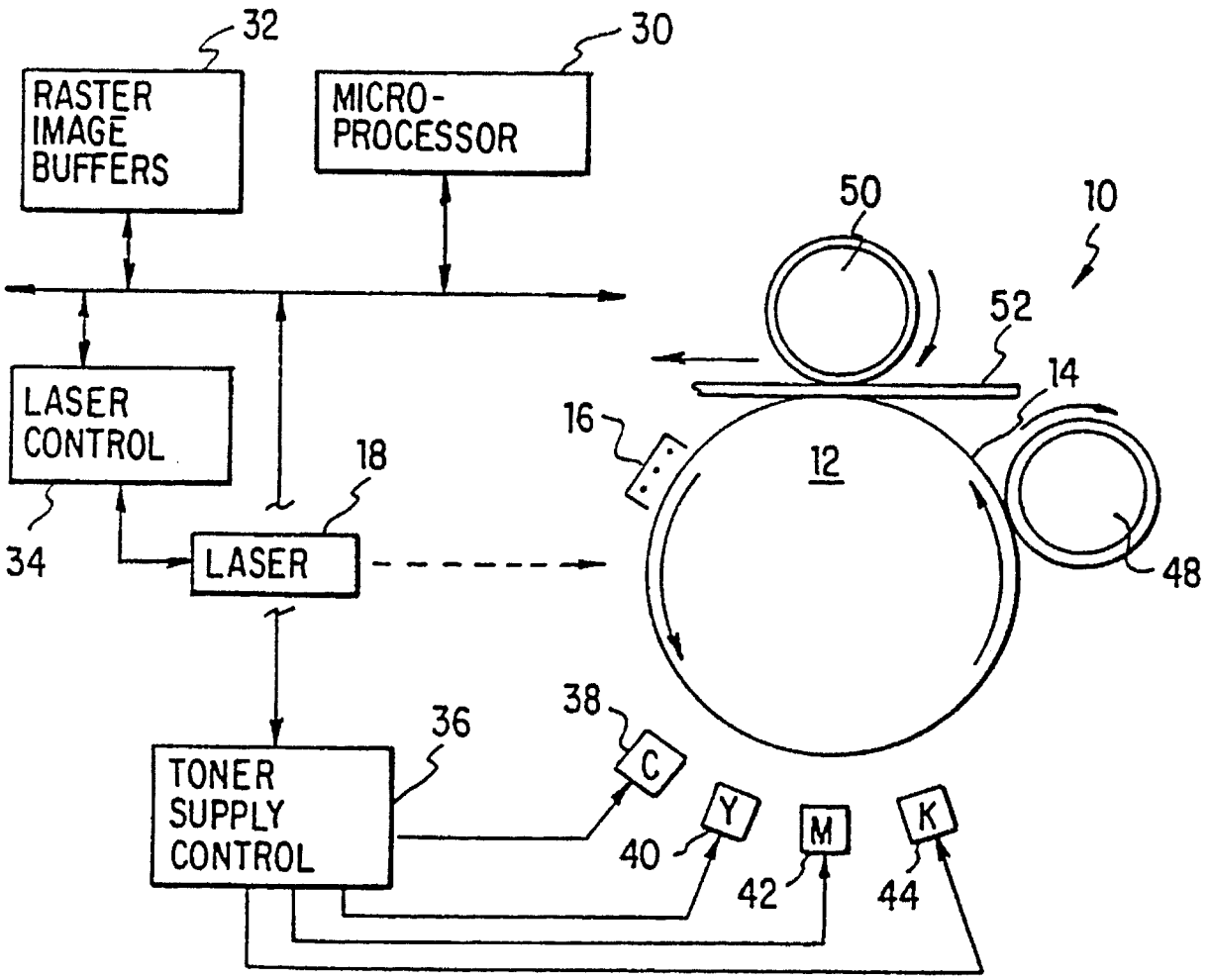
FIG. 1 is a block diagram of an electrophotographic imaging system.

The present invention is not limited to a specific embodiment illustrated herein. Turning to FIG. 1, a color electrophotography system 10 comprises a drum 12 that is coated, in the known manner, with a photoconductive surface 14. While a drum 12 is shown, those skilled in the art will realize that any continuous photoconductive surface 14 may be employed with this invention. An electrostatic charging station 16 charges photoconductive surface 14 as it passes therebeneath. A laser 18 subsequently exposes selected areas of pre-charged photoconductive surface 14 to create image areas that exhibit a different charge level.

Electrophotographic system 10 is controlled by a microprocessor 30 which, in combination with image information in raster image buffers 32, feeds image data to laser 18 through laser control circuit 34. Microprocessor 30 also issues signals to operate toner supply control module 36 which in turn generates signals to control cyan, yellow, magenta, and black toner supplies 38, 40, 42, and 44, respectively. A toner conditioning roller 48 both compresses and heats toner applied to photoconductive surface 14. A transfer roller 50 provides both heat and pressure to a media sheet 52 thereby enabling toner transfer to occur from photoconductive surface 14 to media sheet 52.

In performing a color printing action, raster image buffers 32 contain at least three color planes, e.g., cyan, yellow and magenta. In synchronism with the rotation of drum 12, a color plane is read out and controls laser 18 to cause the particular color plane image to be produced on photoconductive surface 14. Toner supply control 36 then causes the appropriate toner module (e.g., cyan module 38), to operate and to develop the exposed cyan image on photoconductive surface 14. That image is then conditioned by roller 48 and proceeds around drum 12, past electrostatic charging station 16 where photoconductive surface 14 is again charged. A second color plane from raster image buffers 32 is then read out and controls laser 18 to discharge areas of photoconductive surface 14 that are to be developed using a second color toner. (At this point, it is to be noted that there is no media sheet present in contact with drum 12 and such contact will not occur until all color planes have been read out to control laser 18 to produce registered images.) The exposure/development actions proceed through the cyan, yellow, magenta and black toner stations, in sequence, until photoconductive surface 14 has been toned in accordance with the image information contained in all raster image buffers 32.

Figure 2:
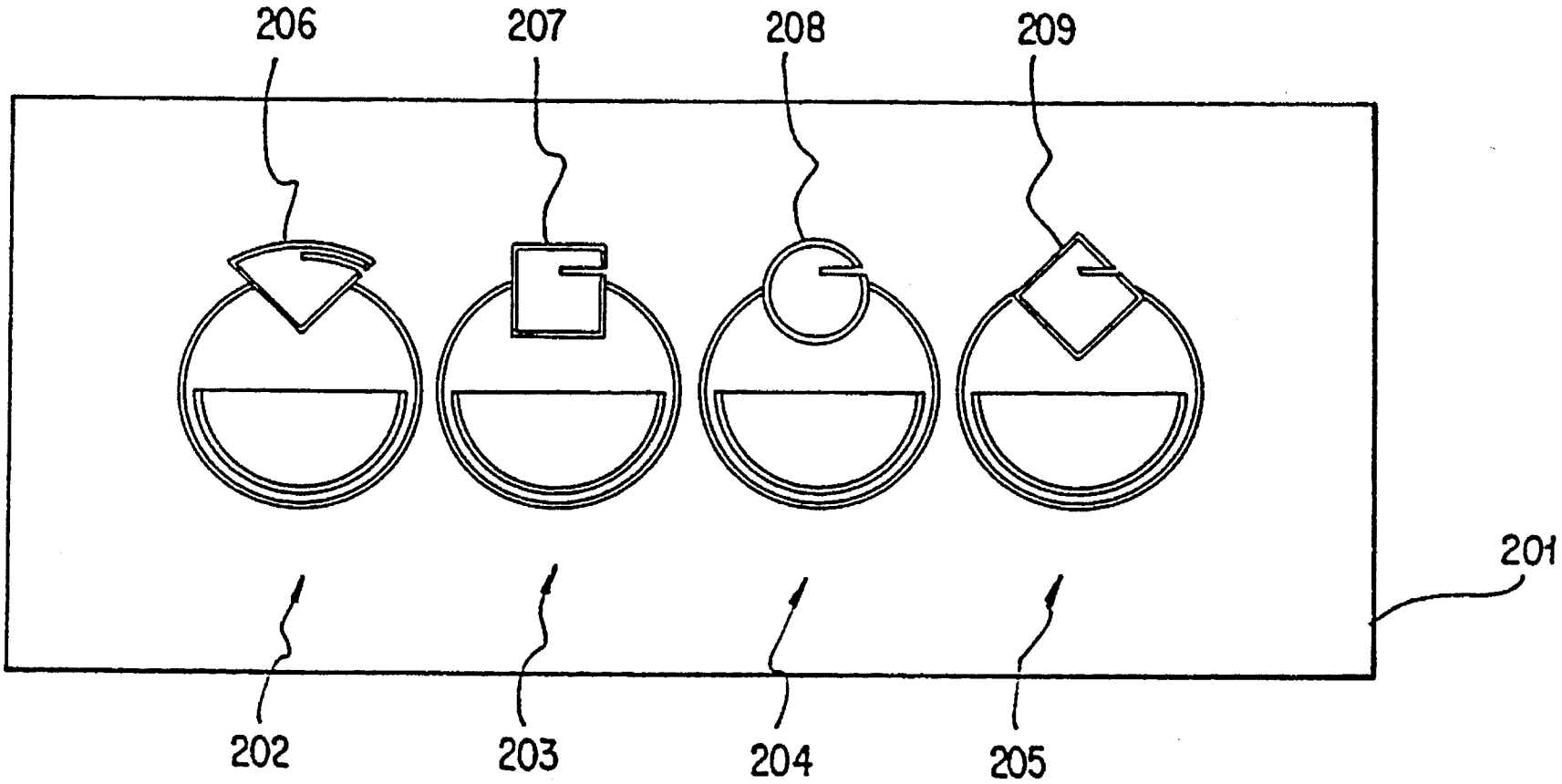
FIG. 2 shows four toner cartridges inserted into their correct receptacles in accordance with the present invention.
Figure 3:
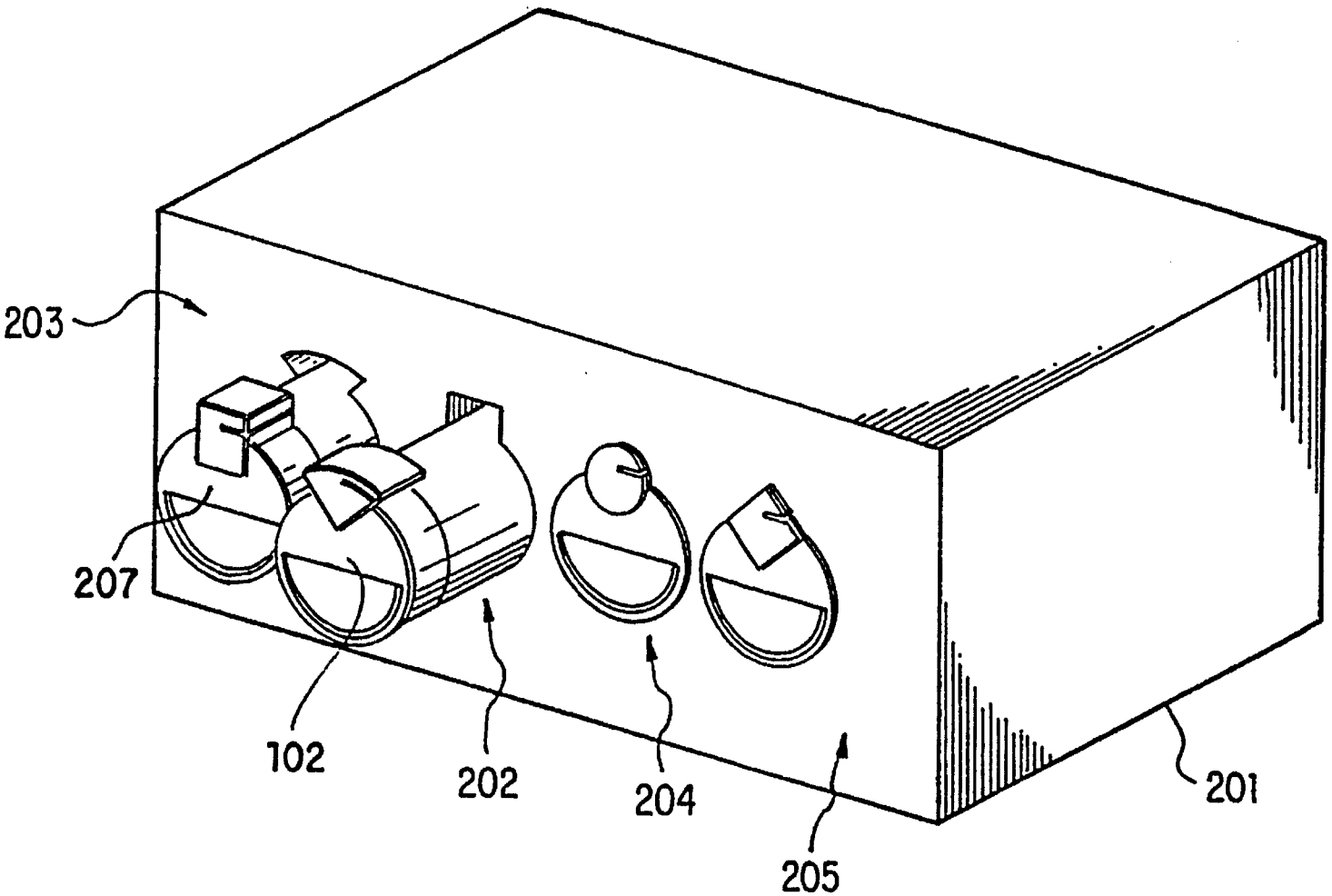
FIG. 3 illustrates the result of attempting to insert a cartridge into the incorrect receptacle.

From the above simplified description of the operation of a color electrophotographic printer, it should be clear that microprocessor 30 must know the proper location of the individual colors to properly render a color image. The preferred embodiment of the present invention uses a unique keying system to insure that a toner cartridge can only be inserted in its designated receptacle. A side view, best illustrating the preferred embodiment, is shown in FIG. 2. Housing 201 depicts a portion of the color electrophotographic system designed to receive the toner cartridges. Formed into housing 201 are four receptacles, one each for four different colored toner cartridges. Each receptacle includes a unique key hole that is designed to receive a corresponding key on a specific colored toner cartridge. Thus, by using the unique end-caps, toner cartridge 202 cannot accidentally be placed into the incorrect receptacle. See FIG. 3.

Another advantage of the housing of FIG. 2 is the ease of replacing a consumed cartridge. Most electrophotographic imaging systems require the user to open the device to gain access to the toner cartridge. By using the preferred embodiment of the present invention, the toner cartridges are designed to be aesthetically pleasing such that there is no need to hide the cartridges behind panels. However, the present invention may also be used behind cabinet doors should the designer so choose.

Figure 4:
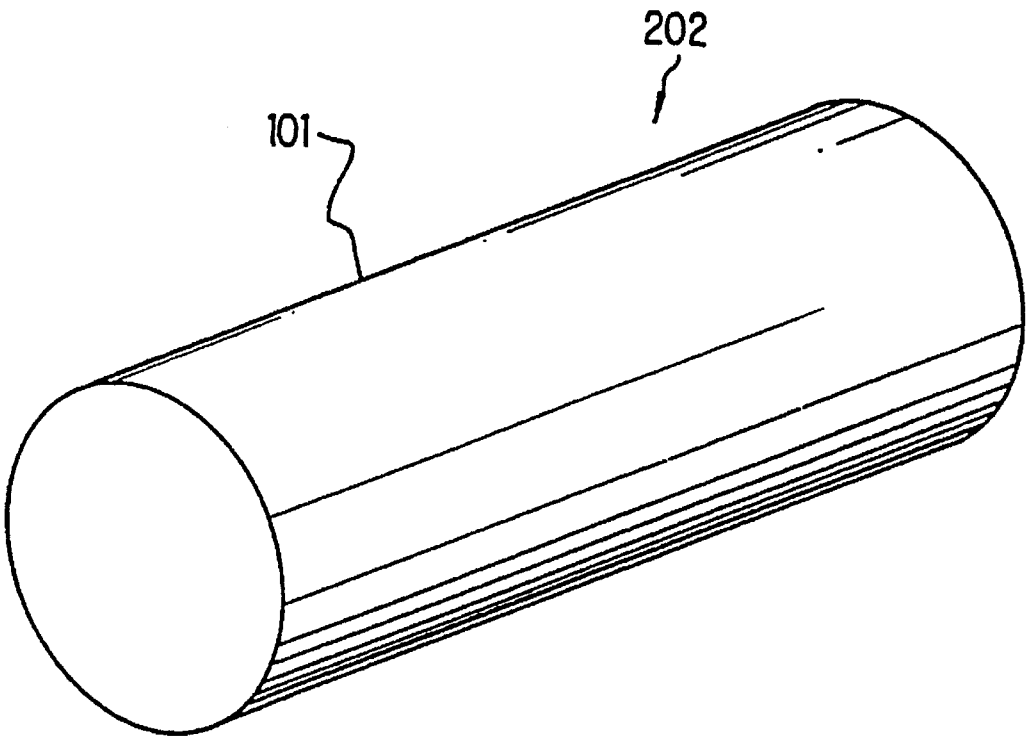
FIG. 4 is a perspective view of a toner cartridge showing a common body and unique endcap.
Figure 4:
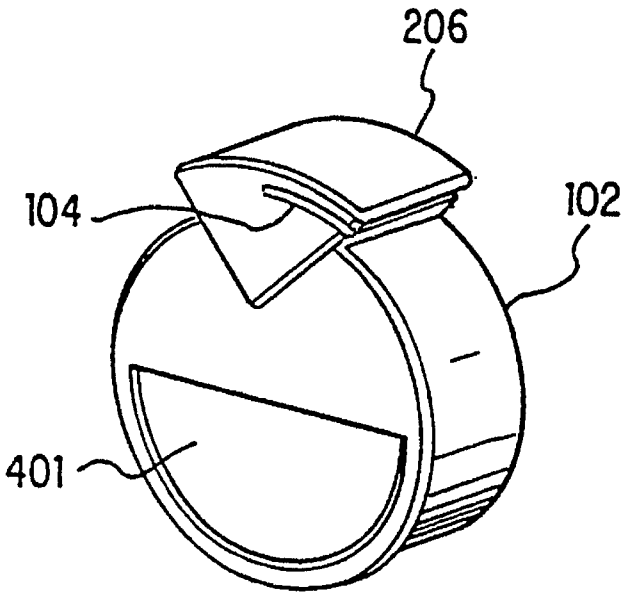

FIG. 4 shows a single toner cartridge 202. Each toner cartridge is constructed from a common cartridge body 101 and a unique end-cap 102. The shape of the end-cap's key 206 indicates the color contained in the toner cartridge. A cartridge is designated a particular color by placing the appropriate end-cap on the cartridge body, Thus, manufacture costs are minimized by requiring manufacture of only one type of the more complicated body 101. One skilled in the art will understand that cartridge body 101 may incorporate changes due to toner differences, the present invention does not preclude such unique designs to the body.

Also shown in FIG. 4 is indicator 104. Illumination of indicator 104 provides visual feedback to the user that toner cartridge 202 is properly seated in the housing 201. Additionally, indicator 104 might flash indicating that toner cartridge 202 is low or out of toner. One skilled in the art can devise other uses and meanings for the indicator. The present invention is not meant to be limited to those functions described here. In the preferred embodiment, indicator 104 is a colored lens that is illuminated by a light source from housing 201. By arranging it so, the disposable toner cartridge 202 does not need electrical contacts through which the indicator 104 is powered.

Figure 5:
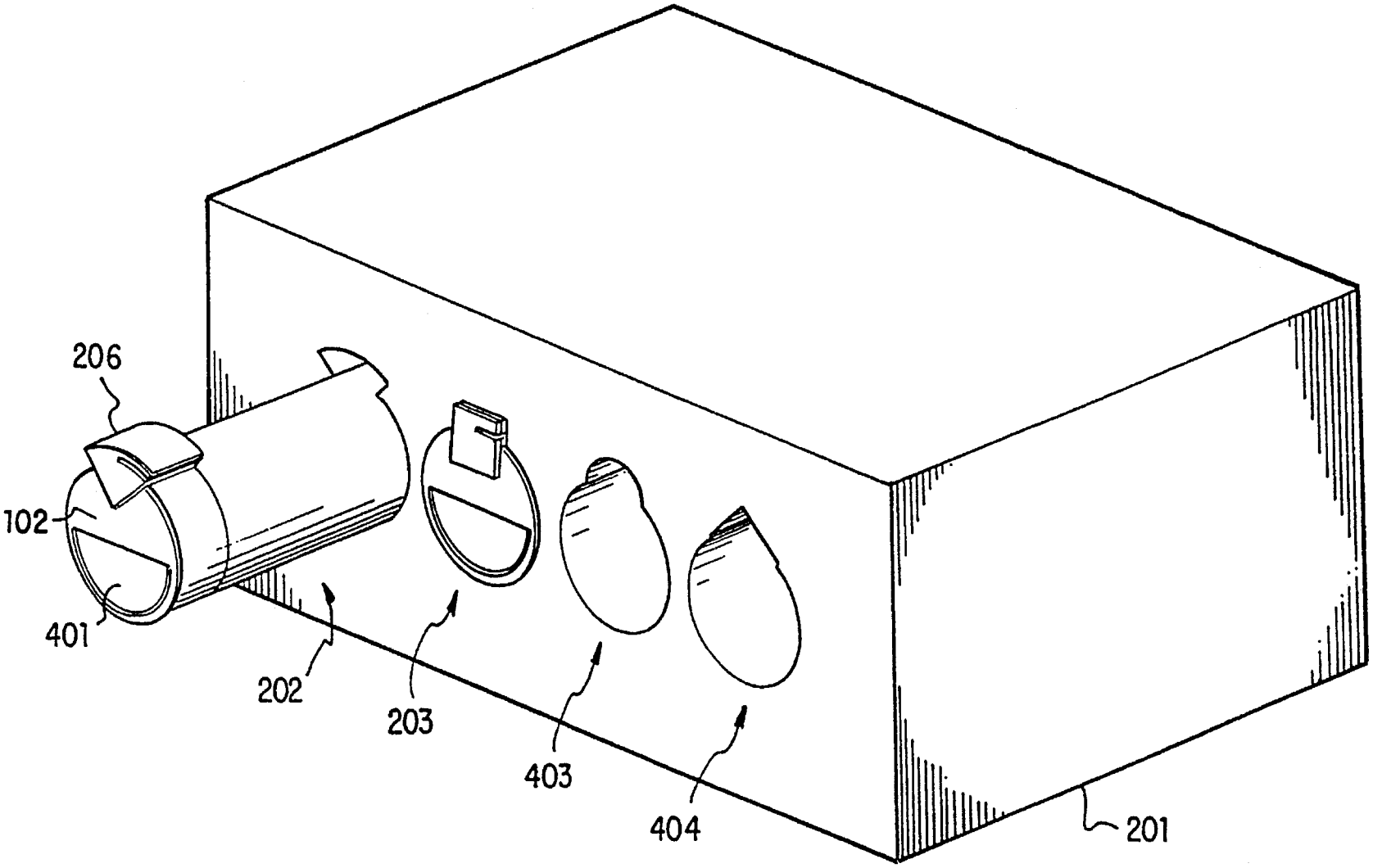
FIG. 5 shows a toner cartridge being inserted.

FIG. 5 is a perspective view showing cartridge 202 partially inserted into housing 201. As described earlier, the endcap 102 of cartridge 202 is formed to include key 206. Indentation 401 is formed in the endcap providing a convenient gripping area for the users fingers to extract toner cartridge 202 from housing 201. Also visible in FIG. 5 are receptacles 403 and 404. These two receptacles are shown with their respective toner cartridges removed showing the respective key receptacle areas therein.

Figure 6:
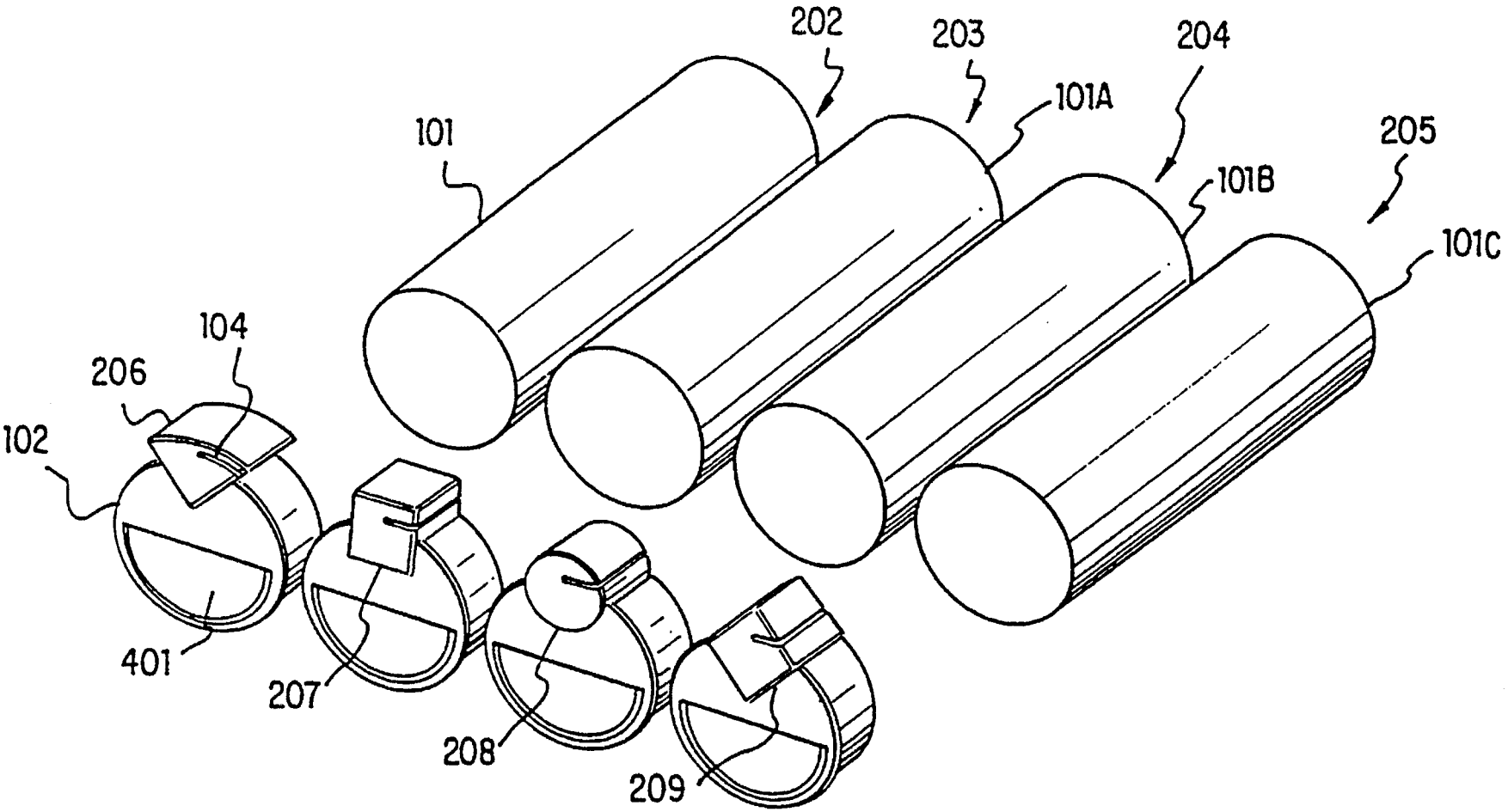
FIG. 6 is a perspective view of all the toner cartridges showing the common bodies and unique endcaps.

FIG. 6 shows a perspective view of toner cartridges 202, 203, 204, 205. Each toner cartridge includes a common body 101–101C which is identical for all of the toner cartridges and a unique endcap 102, 207, 208, and 209. Focusing on one cartridge, the unique endcap 102 includes unique key 206. It is this unique key 206 which prohibits accidental insertion of one cartridge into another receptacle. Endcap 102 includes indentation 401 which provides easy access to the user to extract toner cartridge 202 from housing 201. Also shown in FIG. 6 is indicator 104.

Although the preferred embodiment of the invention has been illustrated, and that form described, it is readily apparent to those skilled in the art that various modifications may be made therein without departing from the spirit of the invention or from the scope of the appended claims.

While the preferred embodiment has been described in conjunction with an electrophotographic printer, the present invention is equally applicable to other type of printing methods. For example, a color off-axis ink-jet printers stores the ink in several non-movable reservoirs. As the ink in a reservoir is consumed, the reservoir must be replaced. Thus, by using the present invention, each reservoir is keyed and only a properly keyed reservoir may be inserted thereby insuring that the correct color ink in replaced.

What is claimed is:

1. A printing apparatus using a plurality of consumables, said apparatus comprising:

a plurality of cylindrical shaped receptacles, one receptacle for each of said plurality of consumables, each receptacle having a unique key receptacle; and a plurality of cartridges, one cartridge for each of said plurality of consumables, each cartridge removably insertable in one of said plurality of receptacles, each cartridge of said plurality of cartridges comprising:

a body having a cylindrical cross section of a first radius, said body having a closed first end and a second end; and an endcap attached to said second end of said body, said endcap having a unique key extending to a second radius where said second radius is greater than said first radius, said unique key mates with one of said unique key receptacles.

2. The printing apparatus of claim 1 wherein said cartridge further comprising a cavity bounded by said body and said endcap, said consumable being contained in said cavity.

3. A printing apparatus using a plurality of colored toners, said apparatus comprising:

a plurality of receptacles, one receptacle for each color of said plurality of colored toners, each receptacle having a unique key receptacle; and a plurality of cartridges, one cartridge for each color of said plurality of colored toners, each cartridge removably insertable in one of said plurality of receptacles, each cartridge of said plurality of cartridges comprising:

a body having a first end and a second end; and an endcap attached to said second end of said body, said endcap having a unique key that mates with one of said unique key receptacles.

4. The printing apparatus of claim 3 wherein said first end of said body being closed forming a cavity inside said body.

5. The printing apparatus of claim 3 wherein:

said endcap having a cylindrical cross section of a radius, said unique key extending to a radius greater than said radius of said cylindrical cross section.

6. A printer comprising:

marking means for placing a mark onto a media;

a first toner;

a second toner;

a first receptacle having a first key receptacle;

a second receptacle having a second key receptacle;

a first cartridge removably inserted in said first receptacle, said first cartridge contains said first toner, said first cartridge comprising:

a first body having a cylindrical cross section of a first radius, said first body having a closed first end and a second end;

a first endcap attached to said second end of said first body, said first endcap having a first key extending to a second radius where said second radius is greater than said first radius, said first key mates with said first key receptacle;

a second cartridge removably inserted in said second receptacle, said second cartridge contains said second toner, said second cartridge comprising:

a second body having a cylindrical cross section of a third radius, said second body having a closed first end and a second end; and a second endcap attached to said second end of said second body, said second endcap having a second key extending to a fourth radius where said fourth radius is greater than said second radius, said second key mates with said second key receptacle.

7. The printer claimed in claim 6 wherein said marking means is an electrophotographic printer.

8. The printer claimed in claim 6 wherein said marking means is an ink-jet printer.

9. The printer claimed in claim 6 wherein said first cartridge further comprising a first cavity that contains said first toner, said first cavity bounded by first body and first endcap.

10. The printer claimed in claim 6 wherein said second cartridge further comprising a second cavity that contains said second toner, said second cavity bounded by second body and second endcap.

* * * * *